US005436535A

United States Patent [19]

Yang

[11] Patent Number: 5,436,535

[45] Date of Patent: Jul. 25, 1995

[54] MULTI-COLOR DISPLAY UNIT

[76] Inventor: Tai-Her Yang, 5-1 Taipin St., Si-Hu Town, Dzan-Hwa, Taiwan

[21] Appl. No.: 998,403

[22] Filed: Dec. 29, 1992

[51] Int. Cl.[6] ..... H05B 37/00

[52] U.S. Cl. ..... 315/313; 315/314; 315/287; 315/362; 315/158

[58] Field of Search ..... 315/313, 77, 161, 314, 315/362, 158, 312, 287, 307; 307/10.8; 313/512; 362/800

[56] References Cited

U.S. PATENT DOCUMENTS 3,704,446 11/1972 Walter ..... 315/77 X
4,329,625 5/1982 Nishizawa et al. ..... 315/312 X
5,072,160 12/1991 Yang ..... 315/307 X
5,254,910 10/1993 Yang ..... 315/313

*Primary Examiner*—Robert J. Pascal
*Assistant Examiner*—Haissa Philogene
*Attorney, Agent, or Firm*—Leonard Bloom

[57] ABSTRACT

A multi-color display unit includes at least a first and second plurality of dot-type light sources, such as LED or small lamps, which are arranged in different geometrical patterns and may be powered in any desired order or combination thereof. Each plurality of dot-type light sources may be of different colors or may include color filters in combination with one-color dot-type light sources to form a multi-color display unit. The geometrical arrangement between those dot-type light sources may include bar-type, and/or circumferences, parallel or intersecting, and a combination with other geometrical patterns.

19 Claims, 2 Drawing Sheets

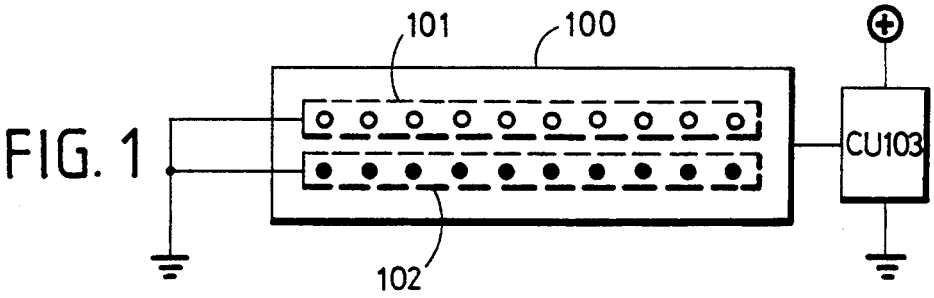
FIG. 1
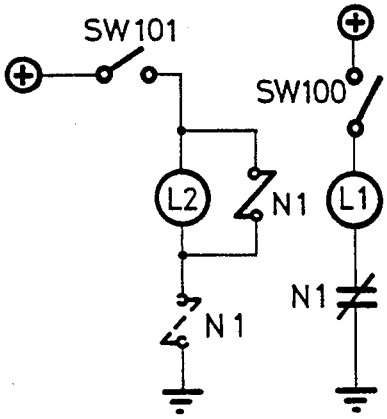
FIG. 1-A
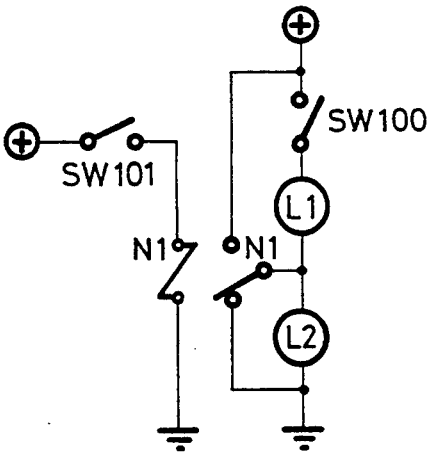
FIG. 1-B
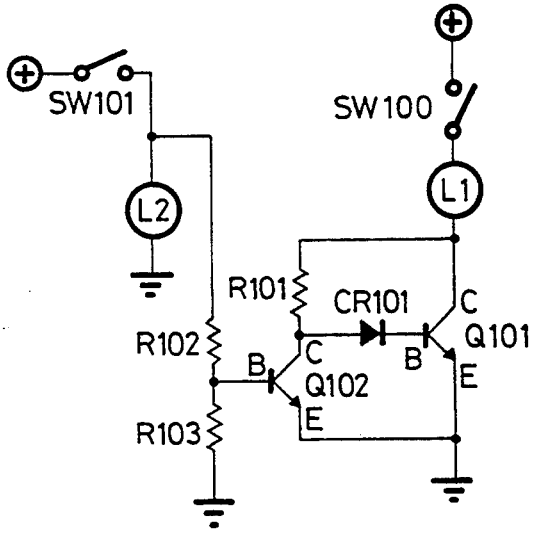
FIG. 1-C
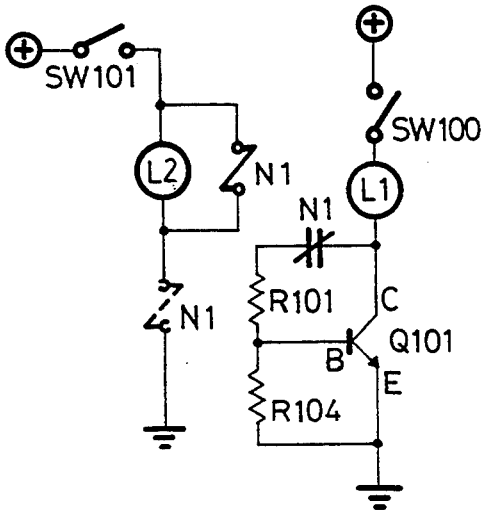
FIG. 1-D

MULTI-COLOR DISPLAY UNIT

FIELD OF THE INVENTION

The present invention relates to a multi-color light source, and more particularly, to the light source which includes a plurality of LEDs or small lamps of different colors or including color filters in combination with uni-color LEDs or small lamps to form a multi-color display unit. Said plurality of LEDs or small lamps may be arranged in different geometrical patterns or in their combinations.

BACKGROUND OF THE INVENTION

Conventional bar-type lighting sources in general consist of mono-color illumination lamps and these mono-color dot-type light sources are arranged in a row for increasing light power. Mono-color light sources may be also accomplished by bulbs projecting to bar-formed light-transmission shade.

It is also known in the art that a brake light or other indicator light may be provided with a transparent housing and two lamps of different colors within said housing. The housing appears differently colored according to which lamp is lit. The lamps are powered selectively by a switch. Different switches are applicable. The above-described color-differential type light display device is disclosed in U.S. Pat. No. 5,254,910 (the inventor of the present invention).

However, none of the prior art references discloses a multi-color display unit including dot-type light sources arranged in different geometrical patterns, which (patterns) may be lit separately or in any desired combination thereby generating a unique optical effect.

SUMMARY OF THE INVENTION

It is, therefore, an object of the present invention to provide a multi-color display unit which would produce light in different colors, different geometrical patterns, and in any desired combinations thereof.

The present invention accomplishes the above-described object with at least a first and a second plurality of spaced-apart dot-type light sources, wherein said at least first and second plurality of dot-type light sources are arranged in certain geometrical patterns (for instance, bar-type parallel or intersecting, circumferencing with a common center or intersecting each other, etc.), and are energized by a controlling means in a desired order.

Said at least first and second plurality of dot-type light sources may include light sources of at least a first and a second color, respectively.

Said dot-type light sources also may be of identical color. Then, in order to create a multi-color effect, a plurality of multi-color filters are employed. These filters are installed in respective apertures of a housing of the display to color a light beam from the respective light source. The filters may be formed as a single lens element, or the lens elements may be arranged in geometrical patterns similar to dot-type light sources geometrical patterns.

Different controlling means embodiments, and wiring connections between said at least first and second plurality of dot-type light sources and controlling means are disclosed below.

These and other objects of the present invention will become apparent from a reading of the following specification taken in conjunction with the enclosed drawings.

BRIEF DESCRIPTION OF THE DRAWINGS

FIG. 1 is a two-color embodiment of the present multi-color display unit including two rows of dot-type light sources.

FIG. 1-A is a diagram showing inhibiting circuit applied for controlling power supply to two lamps (each lamp includes a plurality of dot-type light sources).

FIG. 1-B is a diagram showing the relay contact point and the load in parallel connection with the control-type inhibiting circuit.

FIG. 1-C is a diagram showing the inhibiting circuit including solid-state switch components.

FIG. 1-D is an embodiment of the inhibiting circuit including the relay and solid-state circuit.

DETAILED DESCRIPTION OF THE INVENTION

Figure 2:
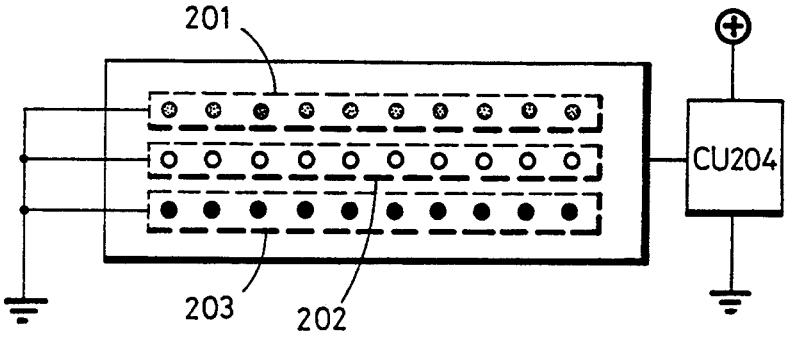
FIG. 2 is a three-color embodiment of the present multi-color display unit including three parallel rows of dot-type light sources.

Referring to FIG. 1, the multi-color display unit includes a lamp shell 100, two rows (101, 102) of dot-type light sources, i.e. a first plurality of first-color dot-type light sources 101, a second plurality of second-color dot-type light sources 102, and a control unit CU103. Based on the control through the control unit CU103, the first-color multi-dot light source 101 can be energized or the second-color dot-type light source 102 is to be energized individually (or both are to be lit or not to be lit, subject to the requirement).

Referring to FIG. 1-A, the state of power supply to the first and/or the second sources 101, 102, are controlled through the inhibiting circuit N1 which is a selective circuit for the two sources 101, 102. The control may be also accomplished through a control circuit. For the purpose of simplicity said first and second plurality of dot-light sources 101, 102 are replaced by a first color lamp L1 and a second color lamp L2. The circuit in FIG. 1-A also includes a switch SW101 for alternating the second-color lamp L2 to be operative or not and simultaneously driving up the inhibiting circuit to cause the first-color lamp L1 Off. Said inhibiting circuit has normally closed contact point at the upper end of synchronously power-up relay N1 parallel (or series with) to the second-color lamp L2 for cutting off power supply to the first-color lamp L1. The first-color lamp L1 is connected in parallel to the normally closed contact point of the inhibiting circuit for being powered up or not. A manual selective switch SW100 is connected in series with L1 in order to determine the first-color lamp L1 as the background color lamp to keep the lamp L1 lit or not lit when the switch SW101 is off so as to increase the flexibility of use.

Referring to FIG. 1-B, the first-color lamp L1 and the second-color lamp L2 are connected in series between a power supply and a ground while the common contact point of the relay N1, controlled by the control switch SW101, is connected to the series connection between the first-color lamp L1 and the second-color lamp L2. The normally opened contact point of the relay is connected to the power supply of the background color selective switch SW100, and normally closed contact point is connected to the ground connection end of the second-color lamp L2. The lamps may be switched by alternating the contact point of the relay controlled by the control switch SW101. The function of background color selective switch SW100 is as mentioned above.

Referring to FIG. 1-C, the inhibiting circuit of FIG. 1-A consists of solid-state switch components. The switch transistor Q101 is parallel to L1, R101 is a bias resistance of Q101 and is connected in series with bias diode CR101 and then in parallel between PIN C (collector terminal) and B (base terminal) of Q101, and PIN C (collector terminal) of inhibiting function by-pass transistor (base terminal) Q102 is in connection with R101 and CR101 while PIN E (emitter terminal) of Q102 is connected to PIN E (emitter terminal) of the transistor Q101. A bias resistance R102 is connected in series with R103, and then in parallel to the series connection of L2, R102 and R103 and is connected to PIN B (base terminal) of the transistor Q102. When L2 is not lit (SW101 is open), the transistor Q102 causes the lamp Q101 to energize the lamp L1. When L2 is powered up (i.e., SW101 is closed), R102 generates bias to activate Q102 while Q101 is off to cause a power interruption to L1. The bias resistances R102 and R103 are in parallel to L2 and may be replaced by the bias generated from the resistance at the ground connection parallel to L2.

Referring to FIG. 1-D, the inhibiting circuit includes a relay and a solid-state circuit which is combined with the inhibiting circuits respectively shown in FIGS. 1-A, 1-B, and 1C. It includes a relay N1 parallel to (or series with) both ends of L2, and the bias resistance R101 parallel between PIN C (collector terminal) and B (base terminal) of the transistor Q101 controlled by normally closed contact point of relay N1 while Q102, CR101, R102 and R103 are omitted. R104 is a bias shunt resistance.

Besides, the normally opened contact point of said relay may be mounted between PIN B (base terminal) and E (emitter terminal) of the transistor Q101 shown in FIG. 1-C, and bias resistance R101 is kept while Q102, R102, R103 and CR101 are omitted.

Referring to FIG. 2, the multi-color display unit of present invention includes three rows of three colors dot-type light sources. It includes a first-color light source 201 (including a plurality of dot-type sources), a second-color light source 202 (including a plurality of dot-type sources), a third-color light source 203 (including a plurality of dot-type sources) and a control unit CU204.

With the control of the control unit CU204, the sources 201, 202,201 can be energized individually; or two of them, or three of them can be energized in any desired combination. It will be appreciated by those skilled in the art that any number of said plurality of dot-type light sources may be employed for the multi-color display unit of the present invention.

With the control of said control units CU103 or CU204, various types of display may be arranged to increase the variations of application.

Figure 3:
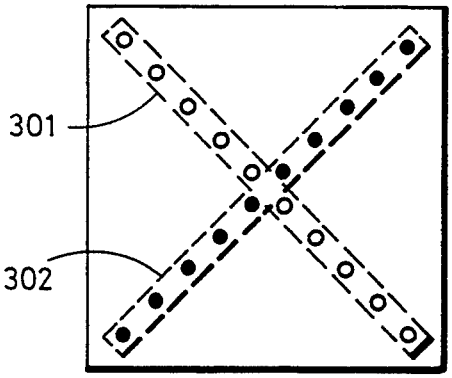
FIG. 3 is a diagram showing the multi-color display unit including bar-type geometrical patterns intersecting each other.

FIG. 3 is a diagram showing the multi-color display unit of the present invention forming a multi-row type display wherein the first-color dot-type light sources are arranged in a row 301 and the second-color dot-type light sources are arranged in a row 302, and these rows 301 and 302 intersect each other. The control switch is operative in combination with any dot-type light sources: parallel and/or intersecting bar-type arrangements,circumferences-type arrangements intersecting or with the common center, etc.

Figure 4:
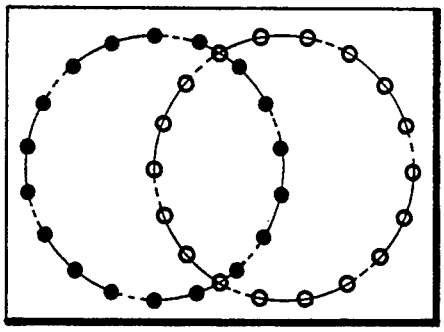
FIG. 4 is an embodiment of the multi-color display unit including circumferences of dot-type light sources intersecting with each other.

FIG. 4 is an embodiment of the multi-color display unit of the present invention where light sources appear as intersecting circumferences.

Figure 5:
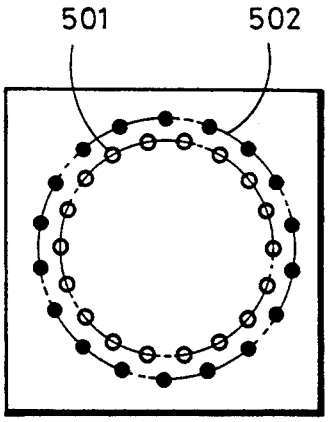
FIG. 5 is a diagram showing the multi-color display unit including circumferences of dot-type light sources having a common center.

FIG. 5 is a diagram showing the multi-color display unit where circumference type light sources have the common center, i.e. the first-color circumference type light source 501 has the same center but different diameter in relation to the second-color multi-dot type light source 502.

Figure 6:
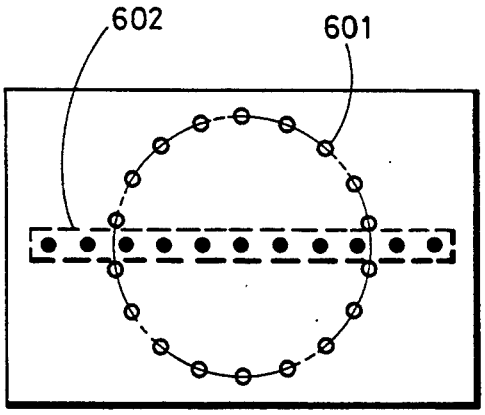
FIG. 6 is a diagram showing the multi-color display unit including a bar-type and a circumference of dot-type light sources intersecting each other.

FIG. 6 is a diagram showing the multi-color display unit having a circular-type and a bar-type light source wherein the first-color multi-dot type light source 601 appears in a circular geometrical arrangement, and the second-color multi-dot type light source 602 appears in bar-type geometrical arrangement.

The multi-color display unit, shown in FIGS. 1 through 6, can also have other geometrical shapes. So far, the multi-color display unit has been discussed, wherein each plurality of dot-type light sources includes dot-type light sources (LEDs or lamps) of different colors. For example, first plurality includes first color dot-type light sources, second plurality includes second color dot-type light sources, etc. However, the multi-color display unit may include dot-type light sources of the same color in all said geometrical arrangements. Then, in order to create a multi-color effect, the display unit of the present invention includes light filters with specific geometrical light-transmitting holes or slots. Thus, the multi-color display unit will include at least a first and a second plurality of uni-color dot-type light sources respectively arranged row by row and individually with lighting filter lens, or at least a first and a second plurality of uni-color dot-type light sources respectively arranged row by row and individually with bar-type lighting filter lens, or desired bar-type lighting filter lens for each color single dot-type light source.

Various types and embodiments of above discussed display unit can be chosen subject to economic requirements and desired optical effect. For example, for peripheral devices, condensing or distracting reflective lens, concave or convex lens, or beehive-type separators to avoid mutual interference of beams generated by each dot-type light source that can be transmitted through the beehive holes, can be chosen, subject to the requirement.

To conclude above statement, the present multi-color display unit including dot-type light sources, arranged in different geometrical patterns, disclose a novel display screen having multi-colored lighting effects, thereby increasing the intensity of lamp screens, their diversity, flexibility and vividness as well as variety of lamp lighting effects.

I claim:

1. A multi-color display unit comprising:

at least a first and a second plurality of spaced-apart dot-type light sources, respectively;

said at least first and second plurality of dot-type light sources being arranged in respective at least first and second geometrical patterns; and a controlling means coupled to said at least first and second plurality of said dot-type light sources, and enabling said at least first and second plurality of dot-type light sources, respectively, in any desired order and in any desired combination of said at least first and second geometrical patterns, wherein said first and second plurality of dot-type light sources are connected in parallel, and wherein said controlling means includes:

a first switching means connected between a power supply and said first plurality of dot-type light sources, a second switching means connected between the power supply and said second plurality of dot-type light sources, and an inhibiting circuit for said first plurality of dot-type light sources, said inhibiting circuit connected to said second plurality of dot-type light sources, wherein said first switching means may be selectively opened to inhibit said second plurality of dot-type light sources to be lit, wherein said first switching means may be selectively closed to pass power to said second plurality of dot-type light sources to light them and simultaneously to activate said inhibiting circuit to inhibit said first plurality of dot-type light sources to be lit, wherein said second switching means may be selectively closed to pass power to said first plurality of dot-type light sources to light them while the first switching means are opened.

2. The multi-color display unit of claim 1, wherein said inhibiting circuit includes a relay, said relay comprising a pair of normally closed contacts in parallel with said first plurality of dot-type sources.

3. The multi-color display unit of claim 1, wherein said inhibiting circuit includes:

a first and a second transistor, said first and second transistor each having a base terminal, an emitter terminal and a collector terminal, respectively, a diode having an anode and a cathode, and a first, a second and a third bias resistance, respectively, wherein said second and third bias resistances are connected in series to each other, wherein said second and third bias resistances are connected in parallel with said second plurality of dot-type light sources, wherein said second transistor is connected by the base terminal between the second and the third bias resistances, respectively, wherein said first transistor is connected between said first plurality of dot-type light sources and a ground, the collector terminal of the first transistor being connected to said first plurality of dot-type light sources and the emitter terminal of the first transistor being connected to the ground, wherein said diode is connected by the anode to the base terminal of said first transistor and by the cathode to the collector terminal of said second transistor, wherein the emitter terminal of said second transistor is connected to the emitter terminal of said first transistor, and wherein said first bias resistance is connected between the collector terminal of said second transistor and the collector terminal of said first transistor.

4. The multi-color display unit of claim 1, wherein said inhibiting circuit includes:

a relay connected in parallel to said second plurality of dot-type light sources, the relay having a pair of normally closed contacts, a transistor connected by a collector terminal to said first plurality of dot-type light sources and by an emitter terminal to a ground, a bias shunt resistance connected between the base terminal and the emitter terminal of said transistor, and a bias resistance connected between the base terminal and the collector terminal of said transistor and controlled by said normally closed contacts.

5. The multi-color display unit of claim 1, wherein said at least first and second plurality of said dot-type light sources include light sources of at least a first and a second color, respectively, said at least first and second colors being different.

6. The multi-color display unit of claim 1, wherein said at least first and second plurality of dot-type sources includes dot-type light sources of identical color, wherein said display unit further includes a housing and a plurality of colored filters, wherein said housing includes respective apertures, each of said plurality of colored filters being received and secured in a respective one of said apertures, in precise registration with respective dot-type light sources to be colored.

7. The multi-color display unit of claim 6, wherein said colored filters are arranged in respective at least first and second geometrical patterns similar to and in precise registration with said at least first and second geometrical patterns of said at least first and second plurality of dot-type light sources.

8. The multi-color display unit of claim 1, wherein said at least first and second geometrical patterns include at least first and second bar-type geometrical patterns.

9. The multi-color display unit of claim 8, wherein said at least first and second bar-type geometrical patterns are parallel to each other.

10. The multi-color display unit of claim 8, wherein said at least first and second bar-type geometrical patterns intersect each other.

11. The multi-color display unit of claim 1, wherein said at least first and second geometrical patterns include at least a first and a second circumference.

12. The multi-color display unit of claim 11, wherein said at least first and second circumferences have a common center.

13. The multi-color display unit of claim 11, wherein said at least first and second circumferences intersect each other.

14. The multi-color display unit of claim 1, wherein said at least first and second geometrical patterns include at least one bar-type geometrical pattern intersecting with at least one circumference.

15. The multi-color display unit of claim 1, wherein said dot-type light sources include light emitting diodes.

16. The multi-color display unit of claim 6, wherein said colored filters include concave lens.

17. The multi-color display unit of claim 6, wherein said colored filters include convex lens.

18. A multi-color display unit comprising:

at least a first and a second plurality of spaced-apart dot-type light sources, respectively;

said at least first and second plurality of dot-type light sources being arranged in respective at least first and second geometrical patterns; and a controlling means coupled to said at least first and second plurality of said dot-type light sources, and enabling said at least first and second plurality of dot-type light sources, respectively, in any desired order and in any desired combination of said at least first and second geometrical patterns, wherein said first and second plurality of dot-type light sources are connected in series between a power supply and a ground, and wherein said controlling means includes:

a first relay having a pair of normally closed contacts and connected to the ground, a first switching means connected between a power supply and said first relay,said first switching means controlling said first relay, a second relay having a common, a normally opened and a normally closed contact point, respectively, said first relay being connected by the common contact between said first and second plurality of dot-type light sources, a second switching means connected between the power supply and said first plurality of dot-type light sources, wherein said first switching means may be selectively opened to inhibit said second plurality of dot-type light sources to be lit, wherein said first switching means may be selectively closed to activate said first relay to close normally opened contact of the second relay to energize said second plurality of dot-type light sources, and wherein said second switching means may be selectively closed to pass power to said first plurality of dot-type light sources to light them while the first switching means being opened.

19. A multi-color display unit comprising:

at least a first and a second plurality of spaced-apart dot-type light sources, respectively;

said at least first and second plurality of dot-type light sources being arranged in respective at least first and second geometrical patterns; and a controlling means coupled to said at least first and second plurality of said dot-type light sources, and enabling said at least first and second plurality of dot-type light sources, respectively, in any desired order and in any desired combination of said at least first and second geometrical patterns;

wherein said at least first and second plurality of said dot-type light sources may include light sources of at least a first and a second color, respectively, said at least first and second colors being different;

wherein said at least first and second plurality of dot-type sources may include dot-type light sources of identical color, and a plurality of colored filters in precise registration with respective dot-type light sources to be colored;

wherein said at least first and second geometrical patterns include at least one bar-type geometrical pattern and at least one circumference in any desired inter-position;

wherein said dot-type light sources include light emitting diodes;

wherein said colored filters include concave and convex lens;

wherein said first and second plurality of dot-type light sources are connected in parallel, and wherein said controlling means includes:

a first switching means connected between a power supply and said first plurality of dot-type light sources, a second switching means connected between the power supply and said second plurality of dot-type light sources, and an inhibiting circuit for said first plurality of dot-type light source, said inhibiting circuit connected to said second plurality of dot-type light sources, wherein said first switching means may be selectively opened to inhibit said second plurality of dot-type light sources to be lit, wherein said first switching means may be selectively closed to pass power to said second plurality of dot-type light sources to light them and simultaneously to activate said inhibiting circuit to inhibit said first plurality of dot-type light sources to be lit, wherein said second switching means may be selectively closed to pass power to said first plurality of dot-type light sources to light them while the first switching means are opened.

* * * * *